US010588799B2

(12) United States Patent
Akesson et al.

(10) Patent No.: US 10,588,799 B2
(45) **Date of Patent: *Mar. 17, 2020**

(54) SHOWER STRETCHER

(71) Applicant: ARJO IP HOLDING AB, Malmo (SE)

(72) Inventors: Bodil Akesson, Malmo (SE); Kajsa Haraldsson, Malmo (SE); Andreas Thomasson, Sjobo (SE); Mats Edberg, Eslov (SE); Richard Nilsson, Lund (SE)

(73) Assignee: Arjo IP Holding AB, Malmo (SE)

( * ) Notice: Subject to any disclaimer, the term of this patent is extended or adjusted under 35 U.S.C. 154(b) by 43 days.

This patent is subject to a terminal disclaimer.

(21) Appl. No.: 15/449,941

(22) Filed: Mar. 4, 2017

(65) Prior Publication Data

US 2017/0172826 A1 Jun. 22, 2017

Related U.S. Application Data

(63) Continuation of application No. 13/497,732, filed as application No. PCT/EP2010/063601 on Sep. 16, 2010, now Pat. No. 9,687,398.

(30) Foreign Application Priority Data

Sep. 23, 2009 (EP) ..... 09171064

(51) Int. Cl.
*A47K 3/28* (2006.01)
*A61G 7/00* (2006.01)
(Continued)

(52) U.S. Cl.
CPC ..... *A61G 7/0005* (2013.01); *A61G 7/012* (2013.01); *A61G 7/015* (2013.01); *A61G 7/0513* (2016.11);
(Continued)

(58) Field of Classification Search
CPC .... A61H 33/00; A61G 7/0005; A61G 7/0513; A61G 7/012; A61G 7/015; A61G 7/07; A61G 7/0755; A61G 7/08
(Continued)

(56) References Cited

U.S. PATENT DOCUMENTS 2,834,032 A 5/1958 Scott
3,613,127 A 10/1971 Bond
(Continued)

FOREIGN PATENT DOCUMENTS

CN 2850597 Y 12/2006
DE 29802043 U1 6/1998
(Continued)

*Primary Examiner* — Tuan N Nguyen
(74) *Attorney, Agent, or Firm* — The Webb Law Firm

(57) ABSTRACT

A shower stretcher assembly (10) includes a frame (22) which supports a platform (20) consisting of three mattress support panels (50-54), and a headboard (16) and foot board (18). The support panels (50-54) define a back rest section (30), a seat section (31) and a foot section (32). The seat section (31) is of flexible material to more closely conform to the shape of a person lying thereon. The stretcher assembly (10) is provided with side barriers (68) at each head and foot end, the side barriers (68) arranged to move between a raised vertical position, a raised position extending outwards from the frame, and a lowered position in which they lie alongside the frame so as to be below the level of the mattress of the stretcher. The side barriers present substantially vertical walls to accommodate a water-resistant mattress with side walls (28).

11 Claims, 5 Drawing Sheets

(51) Int. Cl.

| | |
|---|---|
| ***A61G 7/05*** | (2006.01) |
| ***A61G 7/012*** | (2006.01) |
| ***A61G 7/015*** | (2006.01) |
| ***A61G 7/07*** | (2006.01) |
| ***A61G 7/075*** | (2006.01) |
| ***A61G 7/08*** | (2006.01) |

(52) U.S. Cl.
CPC ..... *A61G 7/07* (2013.01); *A61G 7/0755* (2013.01); *A61G 7/08* (2013.01)

(58) Field of Classification Search
USPC ..... 4/604
See application file for complete search history.

(56) References Cited

U.S. PATENT DOCUMENTS

| | | | |
|---|---|---|---|
| 4,002,330 | A | 1/1977 | Johansson |
| 4,821,348 | A | 4/1989 | Pauna |
| 5,067,189 | A | 11/1991 | Weedling et al. |
| 5,285,539 | A | 2/1994 | Anserson et al. |
| 5,561,873 | A | 10/1996 | Weedling |
| 5,588,167 | A | 12/1996 | Pahno et al. |
| 5,678,257 | A | 10/1997 | Morcate et al. |
| 6,073,291 | A | 6/2000 | Davis |
| 6,421,853 | B1 | 7/2002 | Pecorelli et al. |
| 6,467,106 | B1 | 10/2002 | Heimbrock |
| 6,739,001 | B2 | 5/2004 | Flick et al. |
| 6,898,809 | B2 | 5/2005 | Davis |
| 7,373,680 | B2 | 5/2008 | Davis |
| 7,712,170 | B2 | 5/2010 | Davis |
| 7,725,963 | B2 | 6/2010 | Johnson |
| 7,861,335 | B2 | 1/2011 | DeLuca et al. |
| 8,756,725 | B2 | 6/2014 | Piegdon et al. |
| 2002/0166168 | A1 | 11/2002 | Weedling et al. |
| 2003/0121095 | A1 | 7/2003 | Argento et al. |
| 2005/0076437 | A1 | 4/2005 | Johnson |
| 2006/0213007 | A1 | 9/2006 | Palay et al. |
| 2007/0157376 | A1 | 7/2007 | Paz et al. |
| 2007/0294828 | A1 | 12/2007 | Hornbach et al. |
| 2009/0000027 | A1 | 1/2009 | Jarrett, III |
| 2010/0005592 | A1 | 1/2010 | Poulos et al. |

FOREIGN PATENT DOCUMENTS

| | | | |
|---|---|---|---|
| FR | 2788967 | A1 | 8/2000 |
| JP | S5637825 | A | 4/1981 |
| JP | H10155596 | A | 6/1998 |
| JP | H11267155 | A | 10/1999 |
| JP | 2000093250 | A | 4/2000 |
| JP | 2000197680 | A | 7/2000 |
| JP | 2001095885 | A | 4/2001 |
| JP | 3509574 | B2 | 3/2004 |
| JP | 2005204704 | A | 8/2005 |
| JP | 2006116173 | A | 5/2006 |
| WO | 1998013004 | A1 | 4/1998 |
| WO | 8803790 | A1 | 6/1998 |
| WO | 0021479 | A1 | 4/2000 |
| WO | 2004043792 | A2 | 5/2004 |
| WO | 2007133589 | A1 | 11/2007 |

SHOWER STRETCHER

This is a US non-provisional continuation application, pursuant to 37 U.S.C. § 120(d), of U.S. patent application Ser. No. 13/497,732, filed on Jun. 13, 2012, which is a nationalization, pursuant to 37 C.F.R. § 371, of international patent application no. PCT/EP2010/063601, filed on Sep. 16, 2010, which in turn claims benefit of priority to EP patent application no. 09171064.0, filed on Sep. 23, 2009, all the foregoing applications of which are incorporated by reference in their entirety.

This invention refers to a bathing or shower apparatus for bedridden patients, in particular, a shower stretcher for use in hospitals, nursing homes or like institutions.

Shower stretchers, generally have a platform onto which a patient can be transferred and a trough or similar arrangement is provided around the patient to provide both a water container and splash guard. A patient supported by the platform can then be showered. A drain is located in the depression within the platform to discharge water.

The shower stretcher saves nurses and attendants much heavy lifting when transferring patients from their beds or wheelchairs prior to and after showering. It also allows the attendant to bath a patient at a working height that is more convenient than the conventional bath. The shower stretcher therefore has useful application for long-stay patients in surgical, medical and orthopaedic wards and almost general application for geriatric patients.

The invention seeks to make improvements.

Accordingly, the invention comprises of a bath or shower stretcher comprising a frame supporting a platform and means to raise and lower said platform, characterised in that at least part of the platform surface is flexible to conform more closely to the shape of the person lying thereon. Preferably, the platform comprises a back rest section, a seat section and a foot section. Preferably, the seat section provides a flexible surface for the patient to lie on. This flexible platform provides a more comfortable surface for the patient to lie on, especially when on their side and allows for easier turning of the patient. The platform surface adjusts to the size and weight of the patient and when the back rest is raised, prevents the patient from sliding further down the stretcher, especially in the presence of soap and water during showering.

Preferably, the stretcher includes head and foot side barriers coupled to the stretcher frame, the side barriers arranged to move between a raised position, an extended position, and a lowered position in which they lie alongside the frame so as to be below the level of the mattress of the stretcher. The extended position of the side barriers accommodates larger patients.

Preferably, the seat section has concave sides to present a waisted surface when looking from above the stretcher, to give the care giver better access to the patient and a better working position. More preferably, head and foot side barriers are provided to provide a safer experience for the patient on turning. The side barriers may have handles for manoeuvring the stretcher sideways.

The invention will now be described by way of example only, with reference to the accompanying drawings in which.

Figure 1:
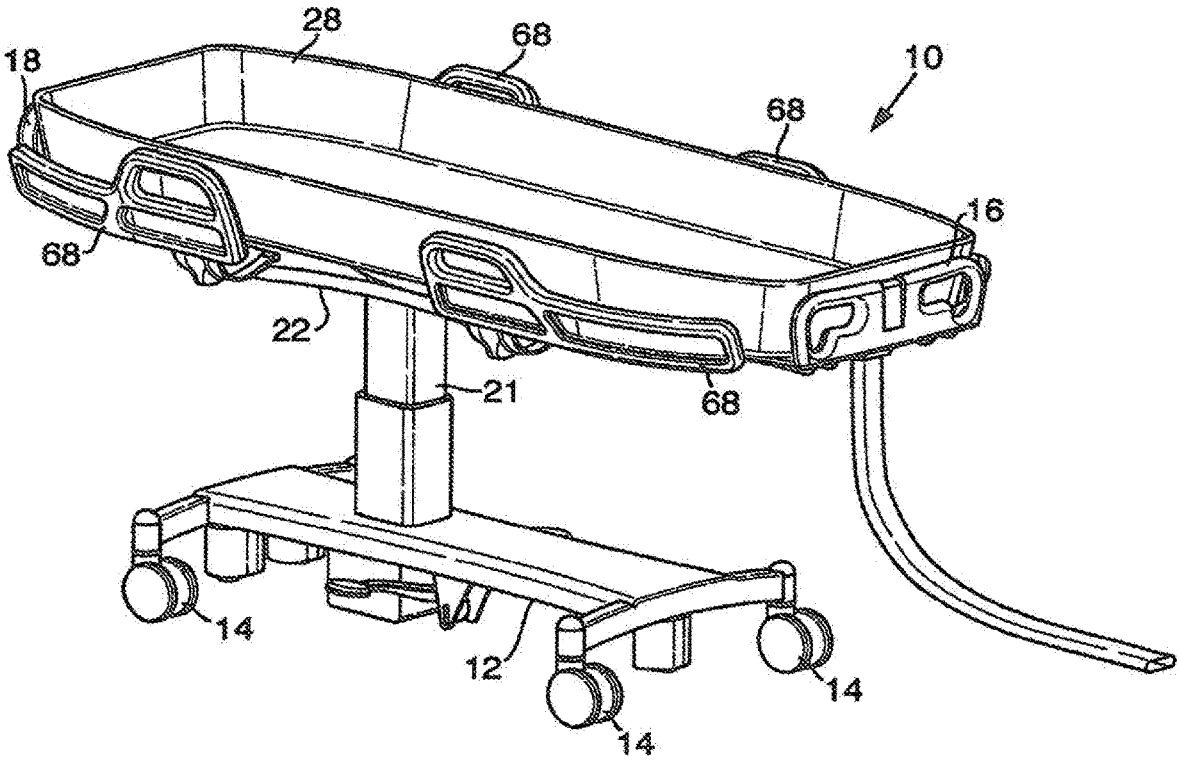
FIG. 1 is a perspective view of the shower stretcher according to the invention.

Referring to FIG. 1, there is shown a preferred embodiment of stretcher assembly 10 which includes a wheeled base 12 provided with four castors 14, a headboard 16 and footboard 18. Coupled to the base 12 is a stretcher platform 20 which can be raised and lowered relative to the base 12 by means of a column 21 of conventional type.

The platform 20 is supported on a frame 22 typically made of metal or a metal alloy and supports a thin mattress of water-resistant material.

The platform comprises three mattress support panels 50, 52, 54. These panels 50-54, form respectively the backrest section 30, seat section 31 and foot rest 32 section of the platform 20.

As can be seen in the Figures, the centre mattress support panel 52 is cut away at the sides so as to present a waisted support surface when looking down on the bed platform 20. The panels 50-54 lie below the side barriers 68, preferably by a distance sufficient to allow a mattress 28 placed on the panels 50-54 to fit within the side barriers 68, the mattress sides held by the substantially vertical side surfaces provided by the side barriers 68. At least some of the mattress support panels 50-54 are preferably removable and advantageously made of injection mouldings from any suitable plastics material. The panels 50-54 may be rigid, but panel 52 is flexible and conforms to the shape of the person lying thereon. Cut outs 60 allow the panel 52 to flex under the weight of the patient. Instead of panel 52 with cut-outs, individual narrow slats arranged longitudinally or transversely in the seat section may be used to perform the same function. Any other flexible material may be used. This flexing is advantageous because it allows a patient to be centred on the centre panel 52 and makes the turning of the patient easier.

Figure 2:
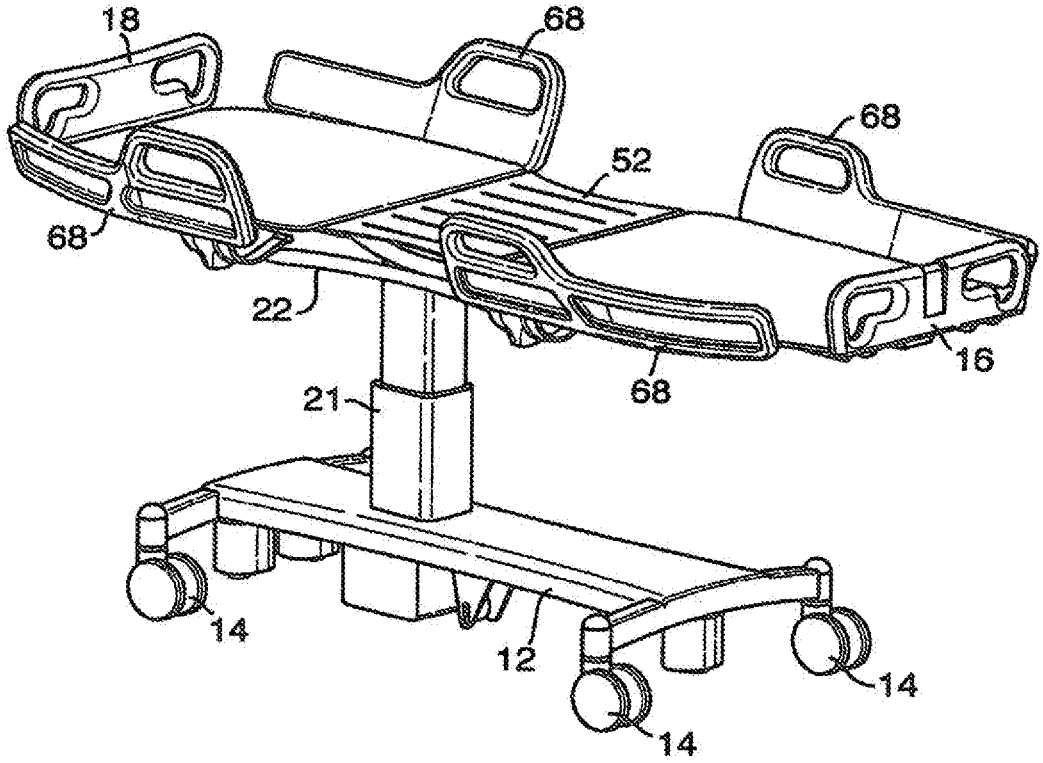
FIG. 2 is a schematic view showing the flexible surface of the platform and the side barriers in their extended position.
Figure 3:
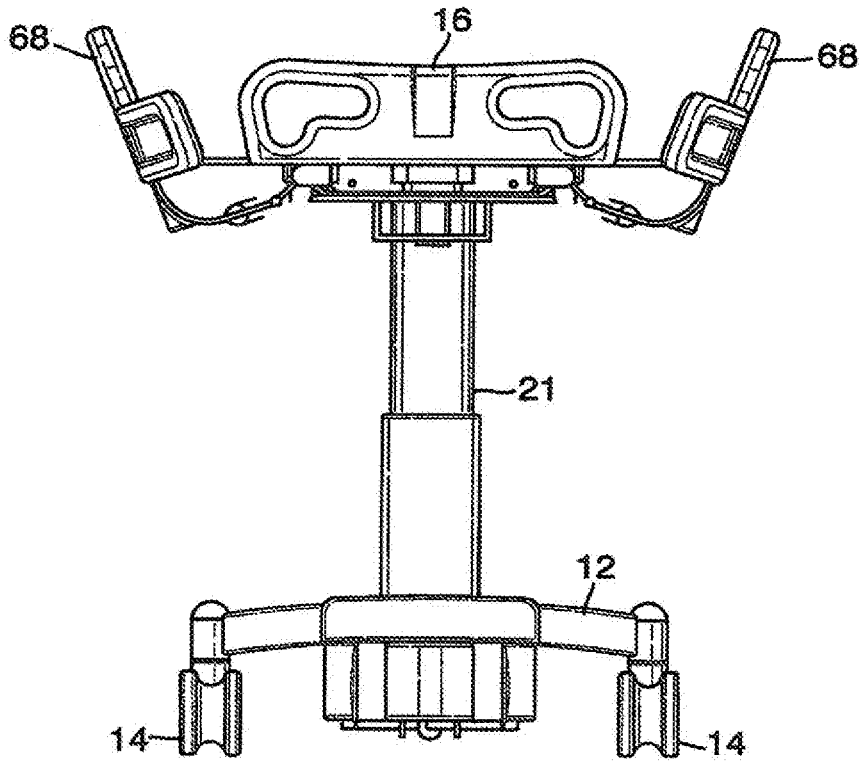
FIG. 3 is an end view of the stretcher in FIG. 2.

FIGS. 2 and 3 also show side barriers 68 coupled to the stretcher frame 22 at the foot end and head end of the stretcher. The side barriers 68 are typically made from a plastics material or from metal covered with a plastics cladding. There are two side barriers 68 on one side and corresponding side barriers 68 are provided on the other side of the stretcher platform 20. These side barriers 68, which can be of a type known in the art, can be moved between the raised position shown in FIG. 3, an extended position shown in FIGS. 2 and 3 and a lowered position in which they lie alongside the frame 22 so as to be below the level of the mattress 28 of the stretcher. In the raised position the side barriers 68 retain a patient on the stretcher and support the mattress 28 sides, while in the lowered position they enable a patient to get off or allow the patient to be transferred onto another bed and further provide unimpeded access to the patient. The extended position of the side barriers 68 allows for the stretcher to be used for larger patients. The shaped side barriers 68 are higher than side barriers in the prior art and provide a safer experience for the patient during turning.

Figure 4:
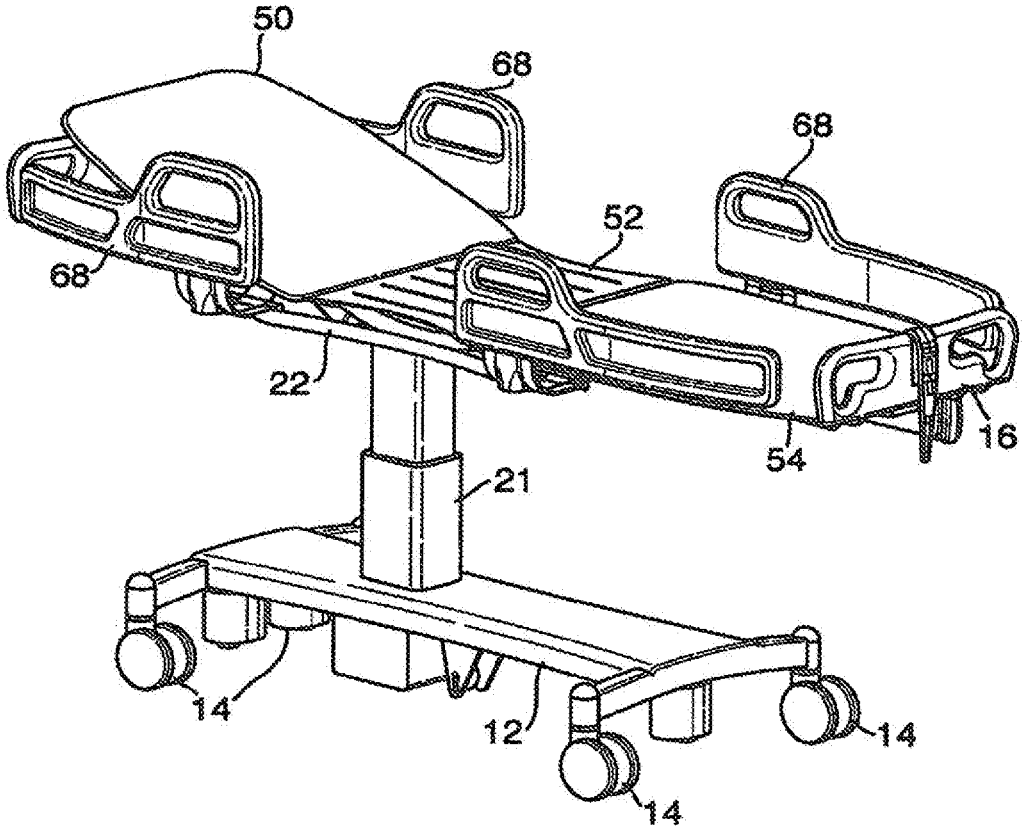
FIG. 4 is a schematic view of the stretcher with the back rest raised.

Referring now to FIG. 4, the stretcher of FIG. 1 is shown with the back rest raised. The back rest 30 can be raised in the manner shown by means of one or more actuators provided in the stretcher assembly 10. The actuators are well known in the art, as is the type of control system used to control them, so they will not be described in further detail herein. In this configuration with the back rest 30 raised, the flexible seat section 31 allows a patient to sink into the seat section 31. This arrangement is advantageous because when a person moves from a lying position to a sitting position the person stretches at the point of bending (that is between the patient's back and lower thighs). Thus, this arrangement follows the extension of the person and therefore makes it much more comfortable to a patient and furthermore prevents the patient from slipping further down the stretcher, especially in the presence of soap and water during bathing. Prior art stretchers, with a flat rigid support surface, do not benefit from this increase in the effective length of the mattress support.

Figure 5:
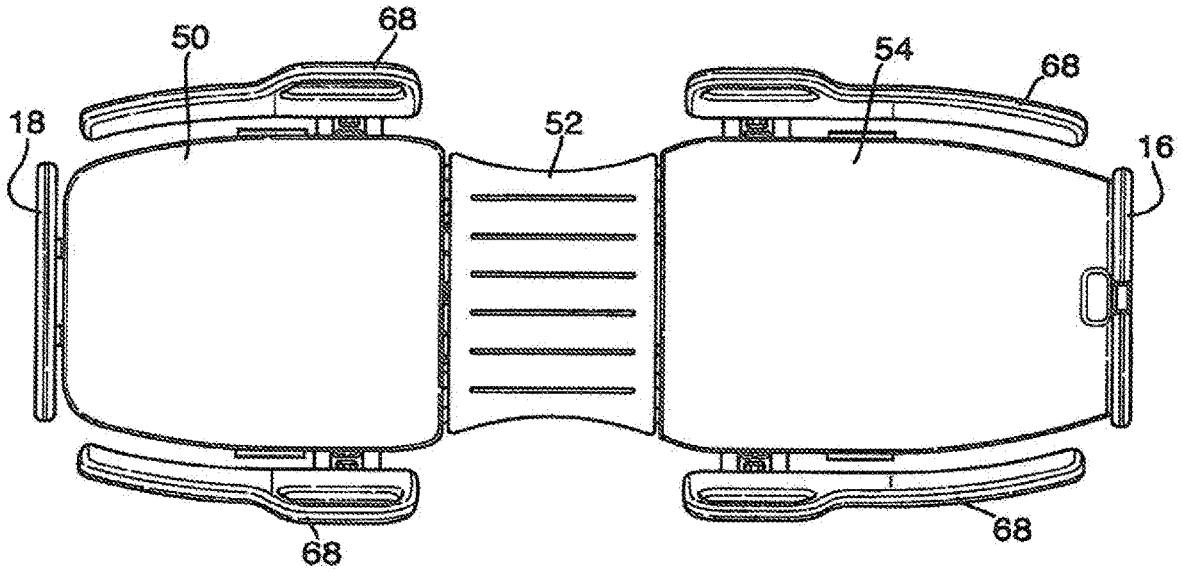
FIG. 5 is a top plan view of the platform according to the invention.

Referring now to FIG. 5, this shows the stretcher features of FIG. 2 in plan view with the frame 20 in a flat configuration. It can be seen that the provision of waisted support panel 52 provides good access to a patient lying on the stretcher.

The invention claimed is:

1. A shower stretcher comprising:

a washing receptacle configured to facilitate washing a person supported therein;

a platform supporting the washing receptacle, wherein the platform comprises:

a backrest section;

a foot section; and a flexible seat section disposed between the backrest section and the foot section, wherein the seat section is configured to flex under the weight of a person and comprises a plurality of openings each extending in a longitudinal direction from the backrest section towards the foot section and through an upper surface and lower surface of the seat section, wherein the plurality of openings are spaced apart from one another in a direction perpendicular to the longitudinal direction.

2. The shower stretcher of claim 1, wherein the flexible seat section comprises a plurality of slats and wherein the slats define the openings formed between the slats.

3. The shower stretcher of claim 1, further comprising a base that supports the platform and is capable of adjusting a height of the platform.

4. The shower stretcher of claim 3, wherein the base comprises a plurality of wheels.

5. The shower stretcher of claim 1, wherein the backrest section is pivotable with respect to the seat section.

6. The shower stretcher of claim 1, wherein the seat section has concave sides forming a waisted configuration.

7. The shower stretcher of claim 1, further comprising a side barrier positioned along a side of the platform, wherein the side barrier is configured to move between a raised position for securing the washing receptacle and a person on the platform and a lowered position to facilitate transfer of a person from the shower stretcher.

8. The shower stretcher of claim 7, wherein the side barrier is positioned along a side of the backrest section or foot section.

9. The shower stretcher of claim 1, wherein the washing receptacle is configured as a water-resistant mattress.

10. A shower stretcher for washing a person, the shower stretcher comprising:

a washing receptacle configured to facilitate washing a person supported therein; and a platform supporting the washing receptacle, wherein the platform comprises:

a backrest section;

a foot section; and a flexible seat section disposed between the backrest section and foot section, wherein the seat section is configured to flex under the weight of and conform to a shape of a person positioned thereon and wherein the flexible seat is more flexible than the backrest section and the foot section, wherein the seat section defines a plurality of openings each extending in a longitudinal direction from the backrest section towards the foot section, and wherein the plurality of openings are spaced apart from one another in a direction perpendicular to the longitudinal direction.

11. The shower stretcher of claim 10, wherein the seat section has concave sides forming a waisted configuration relative to the backrest section and further comprises a plurality of slats forming openings extending from an upper surface to a lower surface of the seat section.

* * * * *